US007691072B2

(12) United States Patent
Choi et al.

(10) Patent No.: US 7,691,072 B2
(45) Date of Patent: Apr. 6, 2010

(54) SPOUT FOR SPRAYING AEROSOL AND MASSAGING AND CONTAINER COMPRISING THE SPOUT

(75) Inventors: Hwa-choon Choi, Daejeon (KR); Moon-jeong Rang, Daejeon (KR); Hyun-seok Park, Daejeon (KR)

(73) Assignee: LG Household & Health Care Ltd., Seoul (KR)

( * ) Notice: Subject to any disclaimer, the term of this patent is extended or adjusted under 35 U.S.C. 154(b) by 1365 days.

(21) Appl. No.: 10/503,875

(22) PCT Filed: Feb. 22, 2002

(86) PCT No.: PCT/KR02/00295

§ 371 (c)(1),
(2), (4) Date: Aug. 6, 2004

(87) PCT Pub. No.: WO03/070312

PCT Pub. Date: Aug. 28, 2003

(65) Prior Publication Data

US 2005/0077400 A1 Apr. 14, 2005

(51) Int. Cl.
*A62B 1/04* (2006.01)

(52) U.S. Cl. ..... 601/17; 601/154

(58) Field of Classification Search ..... 601/15, 601/17, 154, 112, 18, 135, 137, 138, 155, 601/159, 160, 166, 136; 239/556, 602; 401/28, 401/207, 265, 190, 261, 263, 266, 6, 206, 401/278

See application file for complete search history.

(56) References Cited

U.S. PATENT DOCUMENTS 1,117,207 A * 11/1914 Mars ..... 601/154
1,868,893 A * 7/1932 Gentle ..... 128/200.21
1,905,750 A * 4/1933 Robinson ..... 601/17
3,363,968 A 1/1968 Williams
4,458,676 A * 7/1984 Pileggi ..... 601/105
5,284,272 A * 2/1994 Wei ..... 222/192
5,671,547 A 9/1997 Truchet et al.
5,682,875 A 11/1997 Blower et al.
5,893,836 A * 4/1999 Raines ..... 601/69
6,129,469 A * 10/2000 Messer et al. ..... 401/6

(Continued)

FOREIGN PATENT DOCUMENTS

DE 2055159 5/1972

(Continued)

OTHER PUBLICATIONS

European Search Report dated Jun. 2, 2009 for corresponding EP Application No. 02701775.5-1268.

*Primary Examiner*—Steven O Douglas
(74) *Attorney, Agent, or Firm*—Swanson & Bratschun, L.L.C.

(57) ABSTRACT

The present invention relates to an aerosol injection and spout for massages and a container including the same. In more detail, the present invention relates to a container including an aerosol injection and spout for massages that are applied to head skin by directly injecting the aerosol including effective elements and has massage effects by tapping head skin with the spout. The container of the present invention comprises a number of soft projecting parts, a medicine passage connecting to a valve of the container including aerosol with effective elements, and at least one orifice connecting to the medicine passage.

6 Claims, 4 Drawing Sheets

U.S. PATENT DOCUMENTS

| | | | | |
|---|---|---|---|---|
| 6,210,064 | B1 * | 4/2001 | White et al. | 401/279 |
| 6,758,422 | B2 | 7/2004 | Kuo et al. | |

FOREIGN PATENT DOCUMENTS

| | | | | |
|---|---|---|---|---|
| FR | 2581569 | A1 | | 11/1986 |
| JP | 1988-98761 | | | 6/1988 |
| JP | 1991-67659 | | | 7/1991 |
| JP | 08-010301 | | | 1/1996 |
| JP | 08-198352 | | | 8/1996 |
| JP | 08198352 | A | * | 8/1996 |
| JP | 09188370 | A | * | 7/1997 |
| JP | 2000014795 | A | | 1/2000 |
| JP | 2000140051 | A | | 5/2000 |
| KR | 20-237206 | | | 10/2001 |
| KR | 20-252213 | | | 11/2001 |
| KR | 2002-0015740 | | | 3/2002 |

* cited by examiner

SPOUT FOR SPRAYING AEROSOL AND MASSAGING AND CONTAINER COMPRISING THE SPOUT

TECHNICAL FIELD

The present invention relates to an spout for spraying aerosol and massaging and container comprising the spout. More particularly, the present invention relates to an aerosol injection and a spout for a massage and a container including the same which can be applied to head skin and so on by injecting aerosol comprising effective elements and have a massage effect by striking head skin and so on directly as well as by applying drug comprising the effective elements directly.

BACKGROUND ART

Conventional products of aerosol for an injection have been administered only through processes by injecting aerosol onto the very site for an application directly and then rubbing with hands or by injecting on a palm in some amount and then rubbing onto the site for an application. Especially, in case that sorts of hair tonic are tried to be applied to hair skin, they are concentrated to be injected on certain site of the head skin directly and then, arranged by using tools such as comb, brush or the like, or utilized by beating head skin and so on. At this moment, the hair tonics are comprised of effective components that have an effect upon a prevention of hair loss and so on by promoting blood circulation in head skin. As illustrated above, the aerosol products of hair tonic including a typical spout have some disadvantages that they cause pains on head skin while beating head skin directly and injure the head skin, since the spout for spraying aerosol including hair tonic is composed of hard plastic. In addition, there are other problems that on account of these pains and injuries, users are inclined to escape a direct use for head skin with rubbing, which makes a massage effect upon head skin not expected. However, especially like a case that a hair tonic is applied, the loss of hair is prevented effectively by exploiting its effective components through a massage effect and the massage effect can improve the blood circulation of head skin directly. Unfortunately, the aerosol products of hair tonic including conventional spouts are not expected to have such a massage effect upon head skin, since hard spouts are applied.

DISCLOSURE OF THE INVENTION

The present inventors have tried to solve the disadvantages in the conventional technique described above. Therefore, the object of the present invention is to provide an aerosol injection, a spout for a massage and a container which have an outstanding massage effect upon head skin and so on by promoting a blood circulation, which is prepared by conjugating an aerosol product with a spout in a valve stem of valve structure so that the aerosol including effective components in a liquid type, a foam type or a particle type can be injected through the spout onto head skin and so on by beating the head skin and coincidently have a massage effect by beating.

In order to attain the above mentioned object, the aerosol injection and the spout for a massage of the present invention are comprised of several soft projections; a medicine passage connected to a valve of a container including aerosol composed of effective elements; and at least more than one orifices connected to the medicine passage.

Preferably, the spout of the present invention is comprised of an upper plate in which several soft projections are fixed in a body on a hard upper plate and a lower plate in which a medicine passage is formed, wherein they are constructed in a separated mode and fixed in a body against each other. At this moment, the hard upper plate is composed of a central axis forming at least more than one orifice and No. 1 support portion and No. 2 support portion formed on the circumference of the central axis.

Furthermore, the container of the present invention including an aerosol injection and a spout for a massage is comprised of several soft projections onto the valve stem; a medicine passage connected to the valve of the container including aerosol comprising effective elements; and at least more than one orifices connected to the medicine passage, in addition to a conventional container which includes effective elements and a propellant and a valve discharging aerosol including effective elements through pressure of a valve stem.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Hereinafter, the preferred embodiments of the present invention will be explained more clearly, referring to accompanying drawings.

Figure 1:
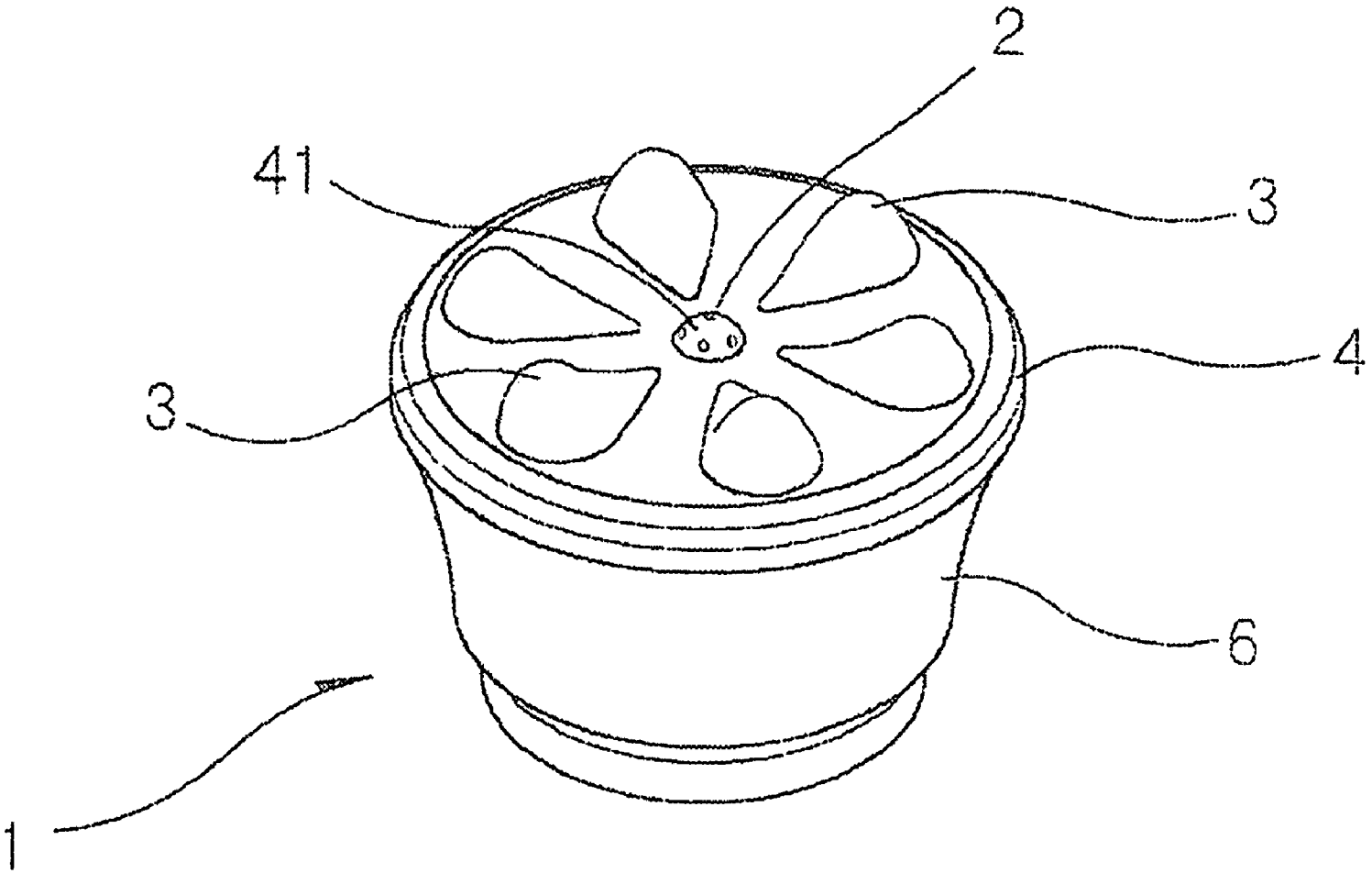
FIG. 1 depicts a squint diagram of a spout schematically according to one embodiment of the present invention.
Figure 2:
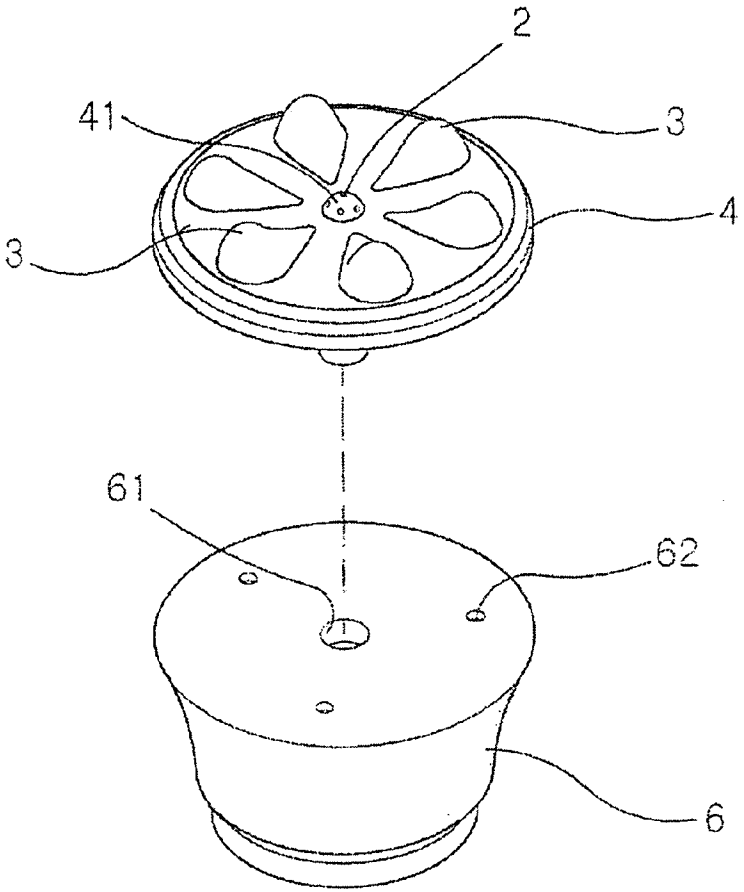
FIG. 2 depicts a squint diagram of resolution in the spout of FIG. 1.

As illustrated in FIG. 1 and FIG. 2, one embodiment of the present invention has a feature that an aerosol injection and a spout for a massage are comprised of several soft projections (3); a medicine passage (63) connected to a valve (8) of a container including aerosol composed of effective elements; and at least more than one orifice (2) connected to the medicine passage (63).

In the above mentioned spout (1), several soft projections (3) can confer a massage effect practically while head skin and so on is beaten at the very site for applying aerosol and be manufactured to have protrusions toward an upper direction by using soft material such as polyethylene, silicon, rubber and the like. However, the material is not be limited within the scope described above. Preferably, the hardness of the projections (3) can be within the range of 20-100 shore A hardness and the strength can be within the range of 10-120 $kg/cm^2$ tensile strength. The above spout (1) has a medicine passage (63) which can inject aerosol discharging from a container including effective components and a propellant in its inside and thus the aerosol can be discharged to its outside through the medicine passage (63) across the spout (1) and applied to head skin and so on. Besides, the spout (1) is comprised of at least more than one orifice (2) connected to the medicine passage (63) and the aerosol discharged from the container can be applied to head skin and so on through the orifices (2). Preferably, the spout (2) is situated at the central portion of the spout (1) and especially, is molded by piercing one end of the central axis (41) present in the central portion. Then, the projecting angle (11) of aerosol is adjusted to be within the range of 45-150° C. and more preferably, within the range of 60-120° C.

Figure 3:
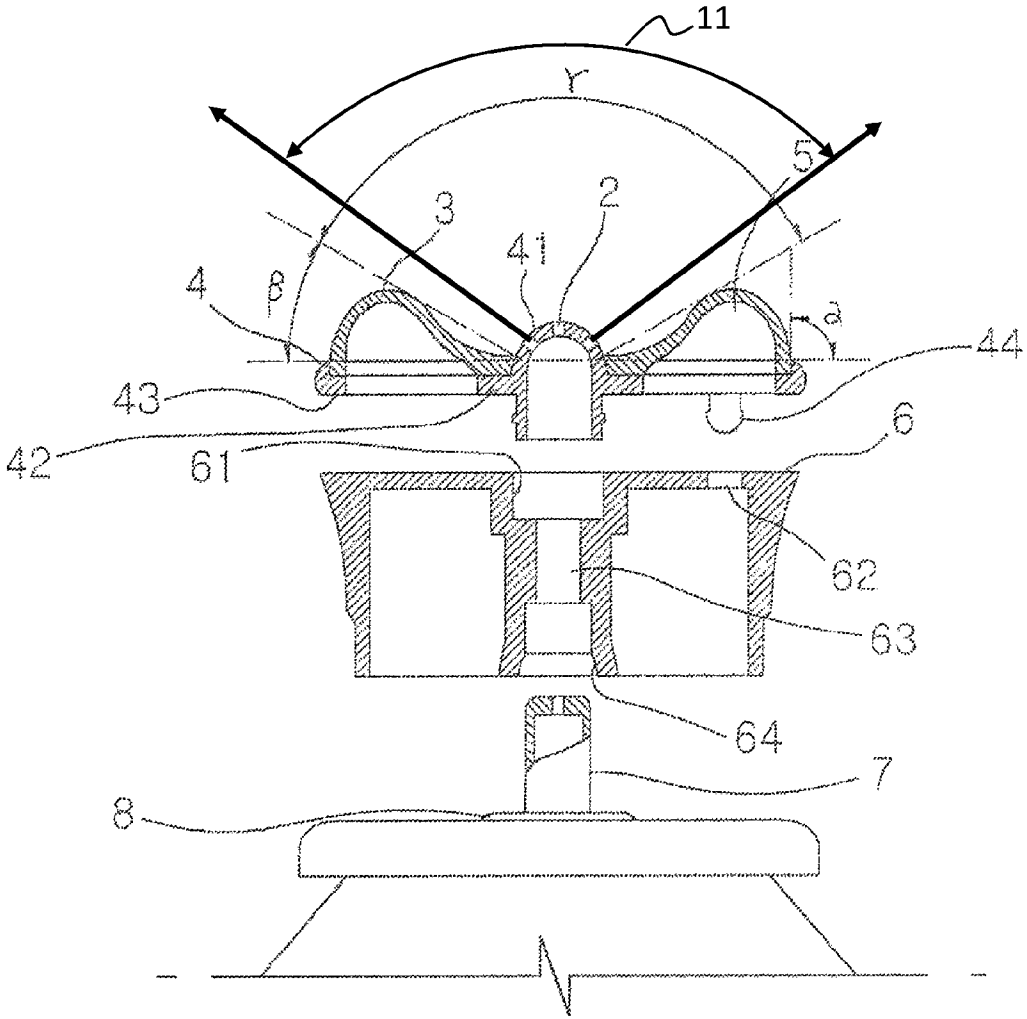
FIG. 3 depicts a cross section of lateral surface in the resolution of the spout of FIG. 1.

As demonstrated in FIG. 3, the projections (3) are manufactured to have the slope angle (α) formed between the outside surface of the projections and the bottom surface of the upper plate (4) which is adjusted to be within the range of 80~100° C. and preferably, less than 90° C. Then, the slope angle (β) formed between the inside surface of the projections and the bottom surface of the upper plate (4) can be adjusted to less than 50° C. and preferably, less than 30° C. Therefore, the slope angle (ϒ) formed between the inside surface of the projections confronting each other is adjusted to be more than 80° C. and preferably, more than 120° C.

The ratio of the slope angles (λ) against the projecting angle (11) of aerosol discharged from the orifices (2) is controlled to be within the range of 1:0.5-1:1.2. In case that the ratio of the slope angle (λ) against the projecting angle of aerosol is less than 0.5, a large amount of aerosol sprayed from the orifices (2) is stuck onto the inside surface of the projections (3), which disadvantageously, might make aerosol not applied on the very site for a practical application such as head skin and so on in a sufficient amount. On the contrary, in case that the ratio is more than 1.2, the site for an actual application of aerosol on head skin and so on become relatively narrower after being sprayed, which also causes some problems.

Preferably, the spout (1) is comprised of the hard upper plate (4) in which several soft projections (3) are fixed on the upper plate (4) in a body and the lower plate (6) in which a medicine passage (63) is formed and fixed in a body confronting each other, which makes a separate mode. At this moment, the hard upper plate (4) is composed of the central axis (41) in which at least more than one orifices (2) are made; and No. 1 support portion (42) and No. 2 support portion (43) formed at the circumference of the central axis (41). The upper plate (4) and the lower plate (6) are conjugated so as to make one spout (1), which can facilitate a process for molding while several soft projections (3) are manufactured by using soft material. The hard upper plate (4) is composed of the central axis (41) in which at least more than one orifices (2) are made; and No. 1 support portion (42) and No. 2 support portion (43) formed at the circumference of the central axis (41). At this moment, the hard property means the hardness higher than that of material forming several soft projections (3) molded on the upper plate (4), which plays a role to improve a massage effect. Precisely, it supports the soft projections (3) actually with the lower plate (6) illustrated clearly as follows and enhances a massage effect while beating head skin and so on by use of the soft projections (3). Besides, it open/closes the valve (8) of the container in which the spout (1) is fixed while beating head skin and so on through the spout (1) and injects aerosol including effective components and a propellant intermittently. In the upper plate (4), the central axis (41) in which the orifices (2) are situated as a standard and No. 1 support portion (42) formed at the circumference of the central axis (41) and No. 2 support portion (43) connected to an outside direction on the same surface of the No. 1 support portion (42) are molded. The No. 1 support portion (42) and No. 2 support portion (43) play a role to support several soft projections (3) formed on their support portions. Therefore, the projections (3) are molded to the upward direction of the No. 1 support portion (42) and No. 2 support portion (43) and a buffering space (5) is made in between these structures. Since the projections (3) are made of soft material and protruded to the upward direction, they are pressed and expanded to original states repeatedly and also touch head skin and so on softly while beaten in practice on head skin and so on. Through this procedure, it confers a massage effect and coincidently does not cause pains and injuries of head skin and feels very comfortable for a more effective massage. Preferably, the lower plate (6) is composed of the medicine passage (63) situated at the central portion, supports the several soft projections (3) by conjugating the upper plate (4), transfers an impulse provoked while beating head skin and so on toward the valve (8) of the container and discharges aerosol including effective components and a propellant in the container across the spout (1) and the orifices (2).

As illustrated in FIG. 3, plate fixing projections (44) which conjugate the upper plate (4) and the lower plate (6) are manufactured in a body on the bottom surface of the upper plate (4) and on the lower plate (6), a fixing projection receiving groove (62) which receives the plate fixing projections (44) of the upper plate (4) and fixes the upper plate (4) on the lower plate (6) is constructed. Besides, in the lower plate (6), an axis receiving groove (61) which receives the upper plate (4) and the bottom portion of the central axis (41) at the central portion can be formed. Through the axis receiving groove (61), the orifices (2) formed on the central axis (41) of the upper plate (4) and the medicine passage (63) of the lower plate (6) are connected so that fluid can be flown each other. Furthermore, a stem injecting groove (64) which can conjugate the valve stem (7) of the container is formed in the lower end of the medicine passage (63) of the lower plate (6) additionally. Hence, the aerosol which is discharged from the container can be injected to the medicine passage (63) of the lower plate (6) through the valve (8) of the container and the valve stem (7) and continue to be discharged to outside across the orifices (2) which is formed at the central axis (41) of the upper plate (4) connected to the medicine passage (63). As a result, it can be applied to head skin and so on.

Therefore, the container of the present invention including an aerosol injection and a spout for a massage has a feature that it is comprised of several soft projections (3) on the valve stem (7) of the container; the medicine passage (63) connected to the valve (8) of the container including aerosol composed of effective elements; and at least more than one orifices (2) connected to the medicine passage (63), in addition to the conventional container which includes effective elements and a propellant and composed of the valve (8) which discharges aerosol including effective components by pressing the valve stem (7). As described above, the container in which the valve (8) is formed is a typical container including aerosol composed of effective elements and a propellant, which is understood well so that those skilled in this art can utilize very easily and purchase from famous manufacturers in the inside and outside of the country. For example, one embodiment is a container including insecticides in an aerosol type and injecting aerosol and thus can be used for an insecticide exterminating flies, mosquitoes and the like.

Figure 4:
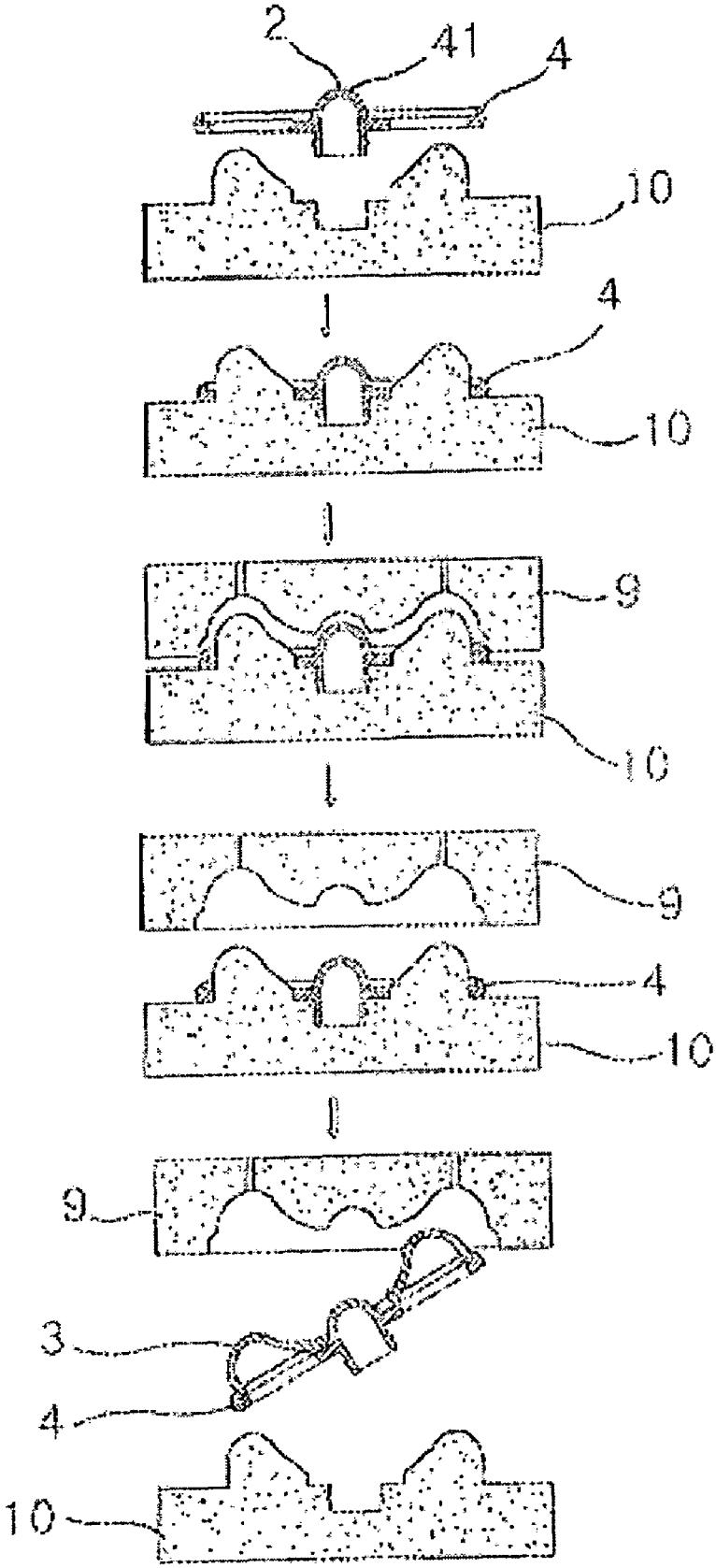
FIG. 4 depicts the process for preparing the spout of the present invention.

As illustrated in FIG. 4, the spout of the present invention is manufactured to form a membrane made of soft material such as rubber on the upper plate (4) comprising the central axis (41) in which the orifices (2) are formed and No. 1 support portion (42) and No. 2 support portion (43). Then, the upper plate (4) is situated within a mold (9, 10) which has a space shaping projections (3) to make several projections (3) and soft material is injected and solidified. The formation of membrane by using such a mold (9, 10) can be performed easily by those skilled in this arts and thus, the injection molding techniques already disclosed and the like can be adopted.

EXAMPLES

Practical and presently preferred embodiments of the present invention are illustrative as shown in the following Examples.

However, it will be appreciated that those skilled in the art, on consideration of this disclosure, may make modifications and improvements within the spirit and scope of the present invention.

Example 1

The spout of the present invention was manufactured by using various kinds of material for spouts as follows and applied to the valve of the container in aerosol products including conventional hair tonic and a propellant.

As material for the upper plate and the lower plate, polypropylene was utilized and as soft material comprising the projections of the upper plate, common rubber having 65 of shore A hardness and 90 kg/cm$^2$ of tensile strength was adopted. Then, the spout having a shape as illustrated in FIG. 1~FIG. 3, was manufactured to form projections by injection molding through the procedure as depicted in FIG. 4.

Example 2

The spout of the present invention was manufactured by performing the same procedure of Example 1, except by using common silicon rubber having 65 of shore A hardness and 58 kg/cm$^2$ of tensile strength as soft material for the projections.

Example 3

The spout of the present invention was manufactured by performing the same procedure of Example 1, except by using common polyethylene resin having 80 of shore A hardness and 30 kg/cm$^2$ of tensile strength as soft material for the projections.

Example 4

The spout of the present invention was manufactured by performing the same procedure of Example 1, except by using polyethylene resin as material for the upper plate and the lower plate.

Comparative Example 1

The spouts of the present invention was manufactured by performing the same procedure of Example 1, except by using polyethylene resin as material for all the upper plate, the lower plate and the projections.

Experimental Example 1~8

The spouts obtained from Example 1~4 and Comparative Example 1 were injected to the valves of containers in aerosol products including common hair tonic and applied to 160 persons of target adults with a scarce number of hairs on the head skin while the spout portions were beaten by performing a method for use. As a result, sensory tests such as a experiment for a massage effect upon head skin, a test for a blood circulation on head skin, an use feeling and the like were investigated by the five points' estimation. In Experimental Example 1~4, 20 of adult persons were made to use only the spout of Example 1~4 respectively (namely, Experimental Example 1 used only the spout of Example 1, Experimental Example 2 used only the spout of Example 2 and others were the equivalent). In Experimental Example 5~8, 20 of adult persons was made to use only the spout of Example 1~4 and Comparative Example 1 respectively and alternatively (namely, Experimental Example 5 used only the spout of Example 1 and Comparative Example 1 alternatively, Experimental Example 6 used only the spout of Example 2 and Comparative Example 1 alternatively and others were the equivalent). Consequently, average values was calculated and demonstrated in Table 1 as follows.

TABLE 1

| Classification | Massage effect | Blood circulation effect | Use feeling |
|---|---|---|---|
| Experimental Example 1 (Example 1) | 3.2 | 3.3 | 3.7 |
| Experimental Example 2 (Example 2) | 4.4 | 4.3 | 4.4. |
| Experimental Example 3 (Example 3) | 3.1 | 3.5 | 2.7 |
| Experimental Example 4 (Example 4) | 4.3 | 4.4 | 4.4 |
| Experimental Example 5 (Example 1/ Comparative Example 1) | 3.3/2.7 | 3.2/2.7 | 3.8/2.9 |
| Experimental Example 6 (Example 2/ Comparative Example 1) | 4.2/2.8 | 4.3/2.9 | 4.3/2.7 |
| Experimental Example 7 (Example 3/ Comparative Example 1) | 3.3/2.8 | 3.5/2.8 | 3.4/2.8 |
| Experimental Example 8 (Example 4/ Comparative Example 1) | 4.3/3.0 | 4.2/2.8 | 4.4/2.9 |

Standard for estimating five points 5: very good; 4: good; 3: average; 2: not good; 1: bad As illustrated in Table 1, the spouts of the present invention (Example 1~4) were investigated to have more outstanding results in the sensory tests in all respects such as the massage efficacy on head skin, the blood circulation, the use feeling and the like than those of Comparative Examples.

Industrial Applicability

As demonstrated and confirmed above, the preferred embodiment of the present invention has an above mentioned constructure and is injected into the valve of the container including effective components such as hair tonic and so on and a propellant. Therefore, while the hair tonic is applied, a proper site on head skin can be taped with a proper amount of effective components only by beating the head skin directly and thus coincidently, the massage effect is conferred by beating the head skin. Consequently, the blood circulation of head skin is promoted and the loss of hair is prevented more effectively. Except the hair tonic, other effective components can be applied on skin and so on having such a indication by beating directly in an aerosol type and thus a proper amount can be administered directly on the relevant site, which excludes possible waste of drugs since it is applied secondarily after placed on palms. Furthermore, while effective elements are administered, the massage effect is conferred without pains, injuries and the like and advantageously, they are injected in a comfortable state and users give a massage more actively to apply effective components. Hence, the spout and the container comprising the same of the present invention can apply effective components such as hair tonic and so on to the head skin directly and coincidently, has the massage effect by taping the head skin.

Those skilled in the art will appreciate that the conceptions and specific embodiments disclosed in the foregoing description may be readily utilized as a basis for modifying or designing other embodiments for carrying out the same purposes of the present invention.

Those skilled in the art will also appreciate that such equivalent embodiments do not depart from the spirit and scope of the invention as set forth in the appended claims.

What is claimed is:

1. An aerosol fluid spout for a massage comprising: an upper plate and a lower plate; wherein the lower plate comprises a medicine passage connected to a valve of a container including aerosol composed of effective elements; wherein the upper plate comprises a central axis on the center of the upper plate as a passage connected to the medicine passage of the lower plate and on which a closed end is included on the opposite direction of the lower plate, at least more than one orifice piercing the closed end of the central axis so as to be connected to the medicine passage, and a plurality of soft projections on the upper plate; wherein the soft projections are projected upwardly and below theirselves have a buffering space, respectively, which is an empty space; wherein the upper plate is made of a material harder than that of the soft projections; and wherein the soft projections are positioned to have radial symmetry around the central axis and only one projection is positioned on any selected straight line between the central axis and the periphery of the upper plate.

2. The aerosol fluid spout for a massage according to claim 1, in which said projections are made of material which has a hardness within the range of 20~100 of shore A hardness and a strength within the range of 10~120 kg/cm$^2$ of tensile strength.

3. The aerosol fluid spout for a massage according to claim 1, in which a slope angle (γ) defined by inside surfaces of said projections confronting each other is adjusted to more than 80° and a ratio of said slope (γ) angle against a projecting angle of aerosol from said orifices (2) is controlled to be within the range of 1:0.5~1:1.2, wherein the projecting angle of aerosol from said orifices is an angle formed by two lines of aerosol projecting from two orifices selected from said orifices.

4. An aerosol fluid device and spout for a massage comprising a container, an upper plate and a lower plate; wherein the container comprises effective elements and a propellant and further comprises a valve stem which discharges aerosol including the effective elements by means of the pressure of the valve stem; wherein the lower plate comprises a medicine passage connected to a valve of a container including aerosol composed of effective elements; wherein the upper plate comprises a central axis on the center of the upper plate as a passage connected to the medicine passage of the lower plate and on which a closed end is included on the opposite direction of the lower plate, at least more than one orifices piercing the closed end of the central axis so as to be connected to the medicine passage, and a plurality of soft projections on the upper plate; wherein the soft projections are projected upwardly and below theirselves have a buffering space, respectively, which is an empty space; wherein the upper plate is made of a material harder than that of the soft projections; and wherein the soft projections are formed to have radial symmetry around the central axis and only one projection is included on any selected straight line between the central axis and the periphery of the upper plate.

5. An aerosol fluid spout for a massage comprising an upper plate and a lower plate; wherein the lower plate comprises a medicine passage connected to a valve of a container including aerosol composed of effective elements; wherein the upper plate comprises a central axis on the center of the upper plate as a passage connected to the medicine passage of the lower plate and on which a closed end is included on the opposite direction of the lower plate, a plurality of orifices piercing the closed end of the central axis so as to be connected to the medicine passage, and a plurality of soft projections on the upper plate; wherein the upper plate is made of a material harder than that of the soft projections, wherein a slope angle (γ) defined by inside surfaces of said projections confronting each other is adjusted to more than 80° and a ratio of said slope (γ) angle against a projecting angle of aerosol from said orifices is controlled to be within the range of 1:0.5~1:1.2, wherein the projecting angle of aerosol from said orifices means an angle formed by two lines of aerosol projecting from two orifices selected from said orifices.

6. The aerosol fluid spout for a massage according to claim 5, wherein the projecting angle of aerosol by the plurality of orifices is in the range of 45° to 150°.

* * * * *